US005676870A

United States Patent [19]

Wassman et al.

[11] Patent Number: 5,676,870

[45] Date of Patent: Oct. 14, 1997

[54] CONVECTIVELY-ENHANCED RADIANT HEAT OVEN

[75] Inventors: Dennis Wassman, Puyallup; Gerald Loveless, Tenino, both of Wash.

[73] Assignee: UltraVection International, Inc., Old Greenwich, Conn.

[21] Appl. No.: 441,177

[22] Filed: Apr. 28, 1995

Related U.S. Application Data

[63] Continuation-in-part of Ser. No. 249,221, May 25, 1994, abandoned.

[51] Int. Cl.[6] ..... F27D 11/02; A21B 1/00

[52] U.S. Cl. ..... 219/400; 126/21 A; 219/393; 219/408; 219/445; 99/340; 99/447

[58] Field of Search ..... 219/385, 391, 219/395, 398, 399, 400, 403, 407, 408, 411, 414, 445, 393; 99/447, 340; 126/21 A

[56] References Cited

U.S. PATENT DOCUMENTS

| | | | |
|---|---|---|---|
| 2,138,706 | 11/1938 | Myers . | |
| 3,109,359 | 11/1963 | Falla . | |
| 3,391,633 | 7/1968 | Boosalis . | |
| 3,585,360 | 6/1971 | Young et al. . | |
| 3,815,489 | 6/1974 | Reid, Jr., et al. . | |
| 3,820,525 | 6/1974 | Pond . | |
| 3,870,193 | 3/1975 | Schneider . | |
| 4,034,661 | 7/1977 | Boosalis et al. . | |
| 4,071,738 | 1/1978 | Jenn et al. . | |
| 4,155,294 | 5/1979 | Langhammer et al. . | |
| 4,261,258 | 4/1981 | Reed . | |
| 4,295,419 | 10/1981 | Langhammer . | |
| 4,357,522 | 11/1982 | Husslein et al. . | |
| 4,444,094 | 4/1984 | Baker et al. . | |
| 4,481,405 | 11/1984 | Malick . | |
| 4,865,864 | 9/1989 | Rijswijck . | |
| 4,894,207 | 1/1990 | Archer et al. . | |
| 5,142,125 | 8/1992 | Fioroli et al. . | |
| 5,254,823 | 10/1993 | McKee et al. | 219/681 |
| 5,309,981 | 5/1994 | Binder . | |
| 5,434,390 | 7/1995 | McKee et al. | 219/681 |

*Primary Examiner*—Tu B. Hoang

*Attorney, Agent, or Firm*—Townsend and Townsend and Crew LLP

[57] ABSTRACT

A convectively-enhanced radiant heat oven includes an elongated cooking chamber with first and second ends positioned opposite each other. A removable holder is positioned in the chamber to hold food items for cooking. One or more heating devices are placed in the chamber to create radiant heat. An air circulating device for circulating heated air within the chamber is positioned within the chamber on the first end. A vent, positioned along a wall of the internal chamber nearest the second end is used to adjust cooking characteristics of the oven. The oven cooks a wide range of foods quickly and efficiently.

20 Claims, 5 Drawing Sheets

CONVECTIVELY-ENHANCED RADIANT HEAT OVEN

This application is a continuation-in-part of Ser. No. 08/249,221, filed May 25, 1994, now abandoned.

BACKGROUND OF THE INVENTION

The present invention relates to ovens used for heating or cooking food items. Particularly, the invention relates to a convectively-enhanced radiant heat oven which permits quick and reliable preparation of a wide variety of foods.

Individuals and businesses who prepare food have long searched for the quickest and most efficient approach to cooking. The problem of designing an oven which cooks quickly is exacerbated by the need to accommodate a number of food types having different sizes, textures, and other characteristics. Even a quick-cooking oven, however, may be not be satisfactory in many situations. The ultimate measure of an oven's utility is consumer satisfaction with the taste of food cooked by the oven. Many approaches have been taken to design ovens which meet the above requirements and which produce quality food items.

For example, conventional conductive or radiant ovens have been found suitable for a number of food types. These ovens use either gas or electricity to heat an oven chamber containing food. The ovens are simple to design, fabricate and use and achieve good results for a number of types of foods. However, conductive and radiative ovens are slow. Efficiency, for individual, restaurant, and institutional users, demands that quality food products be produced more quickly than produced in typical conductive or radiant heat ovens. Further, these ovens are generally not able to produce foods with a deep-fried texture. In conventional ovens, moisture from the foods evaporates into the oven, taking, e.g., juices from red-meat steaks and other foods when it is desirable to retain those juices.

It is well known that moist air heat cooks faster than dry air heat; however, this results in a mushy rather than a crisp exterior of certain items, defeating the goal of retaining the crisp exterior of many foods. This problem may be alleviated somewhat by placing the food directly under a radiant heat source (e.g., "broiling"); however, the food is easily charred or burned before it is fully cooked. Thus, although conventional radiant or conductive ovens are suited for certain foods, they generally cook slowly. Further, they often require a lengthy warm-up time to bring the oven chamber to a desired cooking temperature. This is undesirable in situations where a quick response is required.

Microwave ovens have been found to satisfy the need to cook quickly. These ovens use microwave-length radiation to heat and cook foods. Unfortunately, however, microwave ovens are limited in the types and textures of foods which can be cooked. For example, it is not practical to cook baked goods, traditionally fried or deep-fried foods, or foods requiring a crisp or crunchy texture within a microwave. The microwave leaves these types of foods soggy and otherwise unappetizing.

Another approach to cooking is fry cooking. Foods which are usually fried or deep-fried, such as french fries or onion rings, are best cooked using a uniform high-temperature. Frying the foods in hot oil produces a characteristic crispiness in the food. Deep-fry cooking is a form of convective cooking in which the high-temperature cooking medium (oil or fat) presents a generally uniform high temperature to the food surface. The high temperature causes the outer surface of the food to crisp and further causes the food to cook quickly. However, the food also absorbs an amount of the oil or fat which makes the food less healthy. Another disadvantage of deep fry cooking is that it is only suited for a limited range of foods.

Forced-air convective cooking is another form of cooking which has been used to some success. It is well-known that forced-air convective cooking requires lower temperatures to achieve cooking comparable to a conventional oven. This is generally attributed to the fact that hot air is quickly and uniformly brought to the food surface. Again, however, this type of cooking is not suited to all food types. For example, they are unsuited to cook red meat or traditionally deep-fried food.

Thus, although a number of cooking approaches have been developed, none is ideal. No approach provides a quick, efficient means for cooking a wide range of food items. Further, existing approaches fail to provide control to enable accurate cooking of foods requiring differential heats (e.g., a pizza may need greater heat on the bottom than on the top). Other existing approaches are unsatisfactory because they cook using unhealthy greases or oils or require a relatively lengthy warm-up period.

SUMMARY OF THE INVENTION

Accordingly, a convectively-enhanced radiant heat oven is provided which quickly cooks a wide range of food types without unhealthy oils.

A convectively-enhanced radiant heat oven includes an elongated cooking chamber with first and second ends positioned opposite each other. A removable holder is positioned in the chamber to hold food items for cooking. One or more heating devices are placed in the chamber to create radiant heat. An air circulating device for circulating heated air within the chamber is positioned within the chamber on the first end. A vent, positioned along a wall of the internal chamber nearest the second end, is used to adjust cooking characteristics of the oven.

In one specific embodiment, the cooking chamber is formed with an octagonal cross section to enhance air flow within the chamber. The fan is positioned so that air is forced radially outward and against the end of the chamber. This causes air turbulence around the heating devices, effectively stripping radiant heat from the devices to create convective heat. The combination of radiative and convective heat operates to quickly and efficiently cook a wide range of foods.

The fan and the heating devices may be individually controlled to create specific cooking environments. Control of the fan and heating devices may be facilitated by entry through a keypad positioned on the exterior of an oven cabinet. The keypad may be coupled to electronic control circuitry to directly provide control signals to the heating elements and to the fan. Ovens according to the present invention allow a wide range of foods to be cooked quickly, efficiently, and without unhealthy oils or fats. The ovens require no preheating time.

Initial experimental versions of the present oven employed all three methods of transferring heat to the foods. Conduction was achieved by heating a metal cooking container in which the foods were placed. Radiative heating was employed by placing a heating coil over the food to add a crispness in the foods. Convection was achieved by blowing air transversely over the heating coil and over the foods. It was determined through experimentation with this oven that cooking principally by conduction produced the least authentic fried taste and texture. It was rather determined that the authentic texture and taste of fried foods was best obtained using a combination of convective and radiant cooking as in deep-frying but with air instead of oil or fat as the convective medium.

The oven was therefore improved to exploit convection and radiation and to minimize conduction. A metal basket was substituted for the solid metal food container to surround the food with heated air and substantially reduce the effect of conduction and enhance the effect of convection. Heating rods were placed around the food basket. Because distance from the food greatly changes the cooking result as in broiling, an optimum distance from the food was empirically determined, and a fan was added to obtain the advantages of forced-air convection. The shape of the chamber was also modified and changed to a 8-sided, reflective surface to achieve uniform radiative heat transfer about the food. The result produced a food clearly superior to previous designs and prior ovens.

Fan speed was yet to be optimized, so a variable-speed fan was introduced to facilitate experimentation. The intent was to determine an optimum constant fan speed, but it was discovered that fan speed and air flow had an unexpected effect on the texture of the food. Appropriately adjusting the fan speed during cooking yielded a change in the internal food texture while also varying the crispness of the outer surface texture.

On analysis of the cause and effect of the discovery, it was surmised that the balance between radiative cooking and convective cooking was critical in achieving a desired crispness and texture in the food product. Thus, the oven was further modified to force laminar air flow over the food basket to the fan and then redirected along the oven chamber walls and longitudinally over the heating rods to maximize heat transfer between the rods and the air. The air was thereby heated and the rods were cooled with high air flow resulting in reduced radiative cooking and increased convective cooking. Thus in this mode, the contribution by convection was maximized and the food surface texture was less crisp with the food within more moist and flavorful. Conversely, when the fan speed was reduced, the balance was reversed with less heat being transferred to the air with the heating rods becoming higher in temperature and therefore radiating to the food surface at the higher temperature. With the increased temperature of the food surface from radiative cooking, the food was more crisp.

It was also discovered that the total heat and moisture in the chamber also made an important contribution—it is well-known that moisture in the cooking environment will change the food to a less crisp texture, so a bottom vent was introduced that provided an air exchange. Thus, the fan speed also served to regulate the oven temperature by how much air was exchanged while also regulating the moisture in the oven air.

For a fuller understanding of the nature and advantages of the invention, reference should be made to the ensuing description taken in conjunction with the accompanying drawings.

DESCRIPTION OF THE PREFERRED EMBODIMENT

Figure 1:
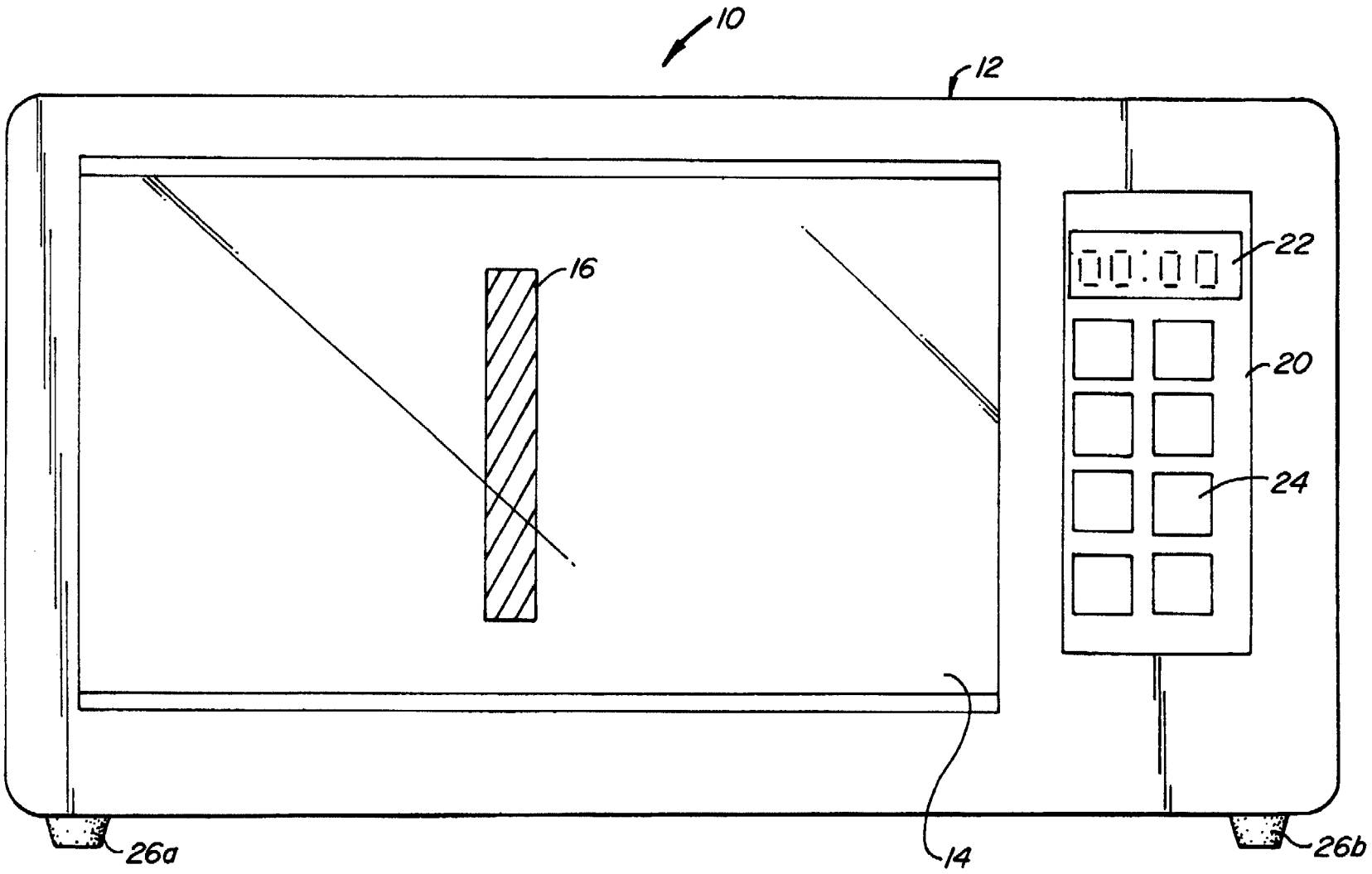
FIG. 1 is a front view of one embodiment of an oven according to the present invention.

One specific embodiment of an oven 10 according to the present invention is shown in FIG. 1. The exterior of the oven 10 includes a cabinet 12, and an access door 14. Preferably, the access door is formed from heat resistant glass to permit viewing of the food items cooking inside the oven 10. The access door 14 has at least one handle 16 on it to permit removal of the door 14 for access to the interior of the oven 10. The oven 10 is controlled via a control panel 20 which may include a display 22 and keypad 24. The control panel, as will be discussed, permits operator control of the oven. The cabinet may be raised from a surface such as a counter by placing feet 26 on the base of the cabinet. Those skilled in the art will recognize that a number of cabinet configurations may be employed, including cabinets which may be built-in to existing cabinetry or the like. Similarly, the control panel of the oven 10 may consist of any of a number of configurations. Digital or analog displays may be used. Simple knob controls may also be used. Those skilled in the art, upon reading this specification, will be able to adapt the present invention to a number of installations and control panel configurations.

Throughout this description, a "consumer" embodiment and a "commercial" embodiment will be referred to. The consumer embodiment is envisioned for home use with 110 Volt electricity service while the commercial embodiment is designed for use in establishments with 220 Volt service. Details of these two specific embodiments will be given. Those skilled in the art, upon reading this disclosure, will be equipped to modify the two specific embodiments by scaling the described teachings to achieve desirable results in different sized ovens.

Figure 2:
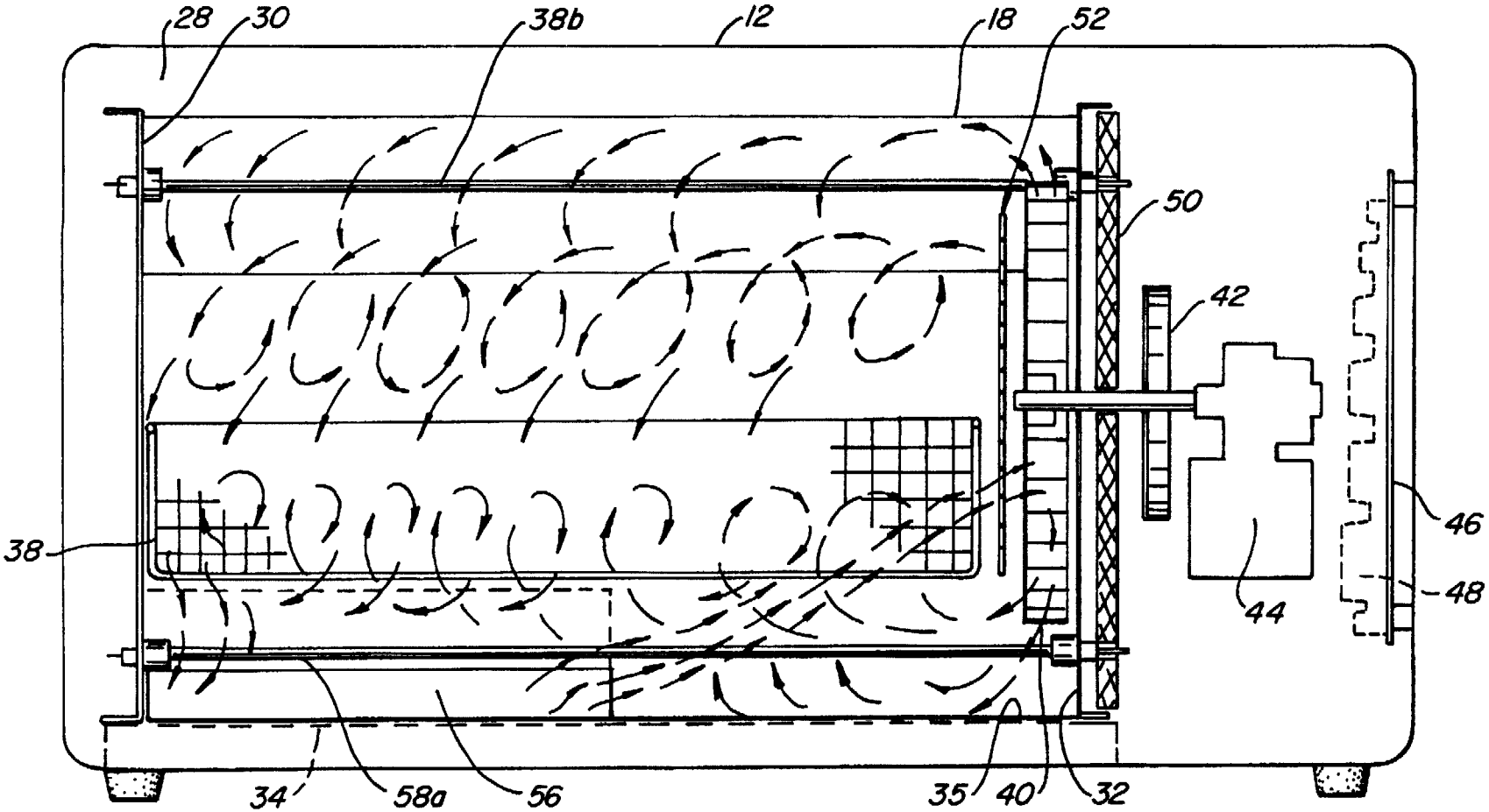
FIG. 2 is a front cut-away view of the oven of FIG. 1.

The internal components of the oven 10 are shown in FIG. 2. The oven 10 includes a cooking chamber 18 into which a food basket 38 is positioned. In a currently preferred embodiment, the cooking chamber 18 has an octagonal cross section. It has been found that this shape of chamber provides desirable results, believed due to the air flow characteristics of the chamber. The chamber 18 is completely contained within the cabinet 12 of the oven. Insulation 28 may be placed between the chamber and the cabinet to minimize heat transfer to the cabinet. The food chamber 18 has a left Side wall 30 and a right side wall 32. The back and top of the chamber may be formed from a single piece of material. The bottom of the chamber is formed from a separate sheet of material to form a drip tray 35. The drip tray 35 may be removed from the chamber 18 through the access door 14 for cleaning. In a preferred embodiment, the food chamber is formed from metal sheeting which is coated on all interior surfaces with a reflective material such as teflon coating. Other coatings and finishes may be used which reflect heat, enable unrestricted air flow, and permit easy cleaning of exposed surfaces. In another specific embodiment, heat absorbent material may be used to coat the interior surfaces of the chamber 18. It has been found that black teflon coating produces satisfactory results;, however, the cooking times are slightly slower for most foods than when a reflective surface is used.

The back edge of the drip tray 35 has an opening formed therein to permit air flow frog a vent 56. In a preferred embodiment the vent 56 is positioned at the opposite end of the chamber 18 from a fan 40. The vent 56 may be adjustable and, preferably, is approximately ⅓ of the length of the chamber. A number of vent sizes have been experimented with. It has been found that the vent 56 is preferably placed along the bottom edge of the chamber 18 at the end furthest from the fan 40. Although variable vents may be used, it has been found that, for one specific embodiment of oven, a preferred vent opening is 0.40 inches in height. Experimentation has shown that vertical adjustments in the vent opening affect the cooking temperature as well as the flavor and moisture content of food cooked in the oven. Placing the vent away from the fan 40 has been found to ensure even cooking within the chamber 18. It has been found that positioning the vent in the manner shown in FIG. 1 produces desirable cooking results. Vents with vertical and/or horizontal adjustment capability may also be used. Further, more than one vent may be used to supply air to the chamber 18.

The food basket 38 is positioned in the cooking chamber 18 by closing the access door 14. The basket 38 is made of, e.g., a wire mesh and has side walls and a bottom. Mesh is used to allow relatively unrestricted convective air flow throughout the chamber. In one specific embodiment, the basket is made of ¼ inch wire mesh. The basket is used to hold food for cooking within the oven. The side walls prevent food items from slipping off the basket while the basket is handled. In one specific embodiment, the food basket 38 is securely attached to the access door 14 so that removal of the access door results in removal of the basket 38. Likewise, when the door 14 is properly closed on the oven, the basket 38 is properly positioned within the cooking chamber 18 of the oven 10. The door and basket may be coupled to the oven 10 in other ways as well. For example, the basket may be slidably coupled to the oven on one or more rails positioned within the chamber. The door may attach to the face of the oven 10 via hinges. However, in the specific embodiment shown, the door 14 is coupled to the basket 38 so they may be completely removed from the oven 10 for cleaning.

The oven 10 also includes a number of heating elements 58. In one specific embodiment, four heating rods 58*a–d* are used, two above the basket 38 and two below it. These heating rods 38 are used to supply a source of both radiative and convective heat to the food. The rods 38 are anchored at both ends 30, 32 of the cooking chamber 18. The right hand end 32 of the cooking chamber 18 includes a heat shield 50 which separates the chamber from control circuitry which will be described. Power is supplied to each of the rods 58 through wiring connected to the heat shield end of the rods. A number of heating elements may be used, depending upon the application for which the oven will be used. For example, in one specific consumer unit, four heating rods are placed within a cooking chamber 18 12" long, 8" high and 8½" deep (contained within a cabinet 12 9⅛" high, 17¼" long, 9⅛" deep). Two 400W heating rods 58 are placed about four inches above the food basket 38 and are spaced approximately three inches apart, while two 350W rods are placed approximately two inches below the basket and'spaced about 1½" apart. In consumer models, any heating rod may be used which operates on house current (110 Volts at under 14 amps) may be used. Quartz, metal, halogen or infrared or other rods may be used. The number of rods was chosen to maintain uniformity of radiative heating on the food while maximizing the rod temperature within the limits of energy that can be drawn from household 120 volt power outlet. More rods would require the power per rod to be reduced and hence would reduce the temperature of each rod.

In embodiments for use in commercial settings (i.e., having access to 220 volts), a larger cooking chamber 18 may be used. For example, the chamber 18 may be 15" long, 10.5" high, and 11" wide and may fit within a 21.5" by 12" by 12" cabinet 12. In such an application, the heating capacity may be increased by using larger heating rods. For example, 0.44 inch Calrods may be used. In one specific embodiment, the heating rods 58 are placed 5.5 inches above and below the food basket 38. Again, heating capacity may be increased by using higher output rods such as rods made from quartz.

Figure 3A:
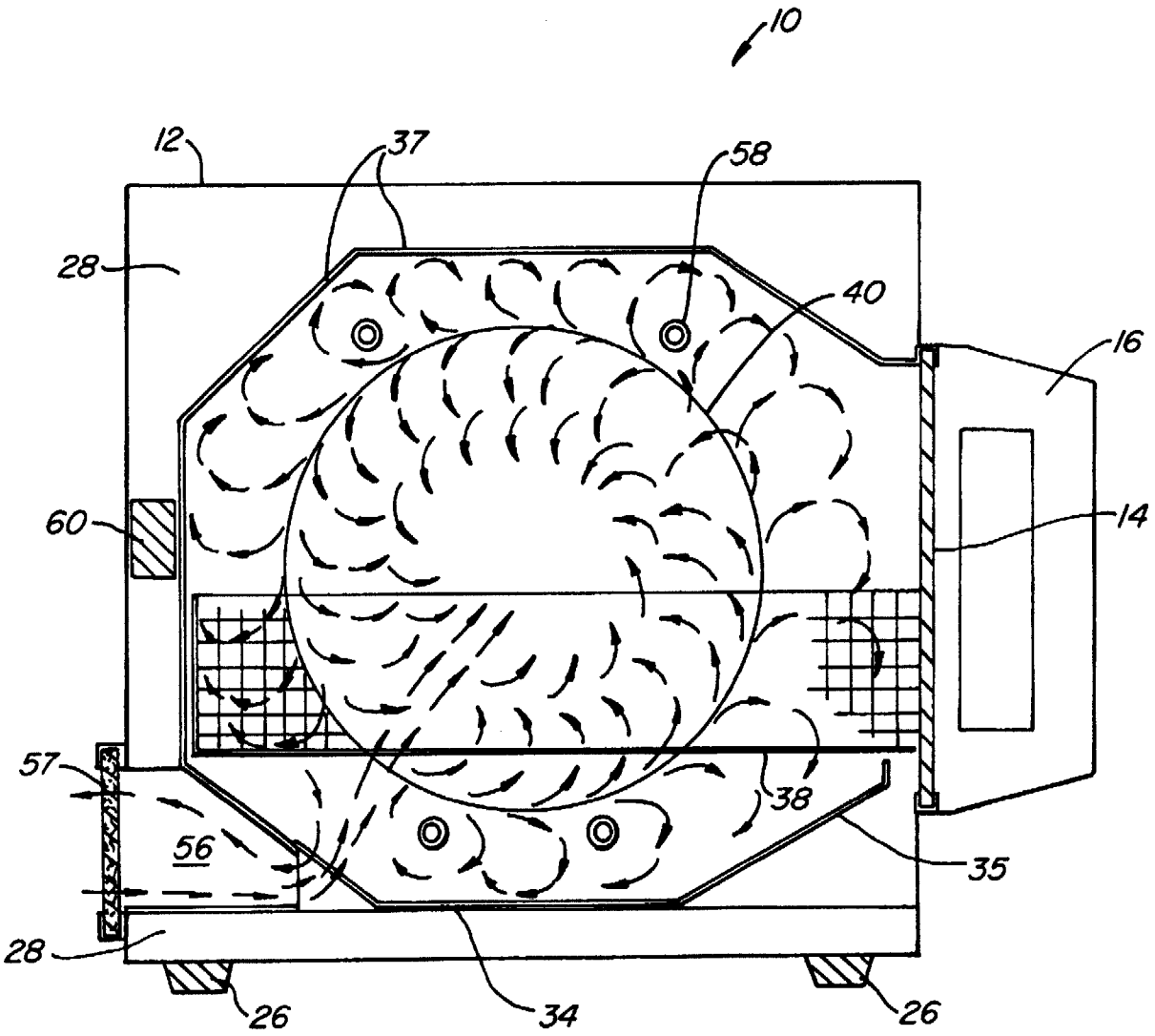
FIG. 3A is a side cut-away view of the oven of FIG. 1 showing air flow within the chamber of the oven.
Figure 3B:
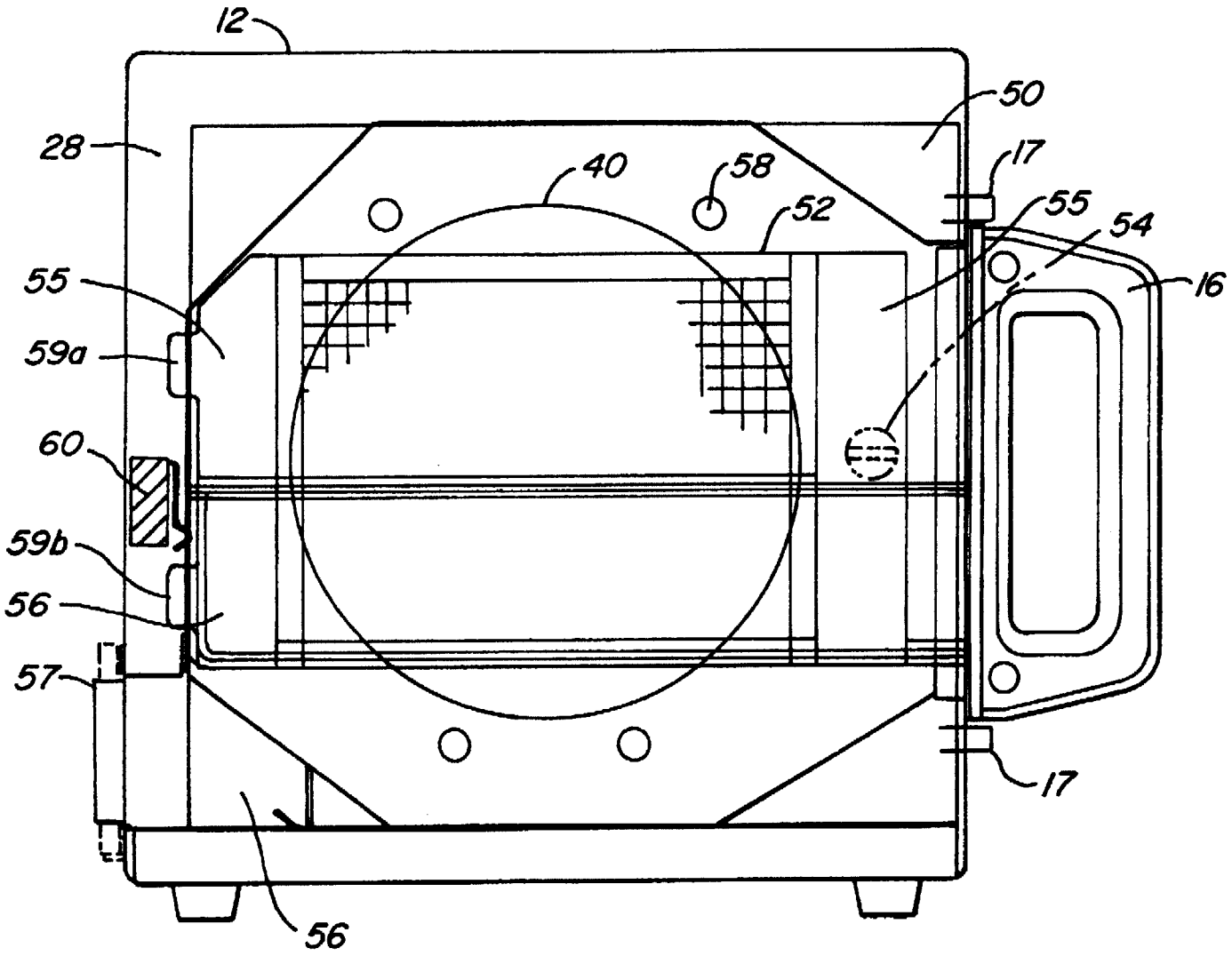
FIG. 3B is a second side cut-away view of the oven of FIG. 1.

The relative positioning of the heating rods 58, the food basket 38, and the vent 56 within the oven 10 are shown in FIGS. 3A and 3B. The vent 56 may include a filter 57 which is placed on the exterior of the oven cabinet 12. The filter 57 may be removable for cleaning or replacement. The exterior of the cabinet 12 may also include a damper for adjusting the airflow through the vent 56. FIGS. 3A and 3B also show that the upper and rear portions of the octagonal chamber 37 may be formed from a single sheet of material. The removable drip tray 35 is formed from a separate sheet of material to permit removal and cleaning of the tray. The drip tray 35 may rest directly on the floor of the oven 34. A notch is formed in the rear portion of the drip tray 35 to form a vent 56. The chamber 37 is separated from the cabinet 12 by insulating material 28. The floor of the oven 28 may also be formed from heat insulative material to prevent heat transfer through the feet 26 of the oven.

A sensor 60 may be placed either outside the chamber 37 or inside the chamber 37. The sensor may be coupled to the control electronics 48 and is used to detect the temperature within the chamber. In one specific embodiment, the sensor is designed to act as a safety kill switch which ensures that no further power is applied to the heating elements 58 when the temperature exceeds a certain value (e.g., 450° F.). The heat limit may be set higher as well. Further, the sensor 60 may be used as a thermostat to set and maintain a target temperature within the oven chamber 18. In another embodiment, the sensor 60 is placed through wall 32 of the chamber, and extends through the heat shield 50.

Figure 4:
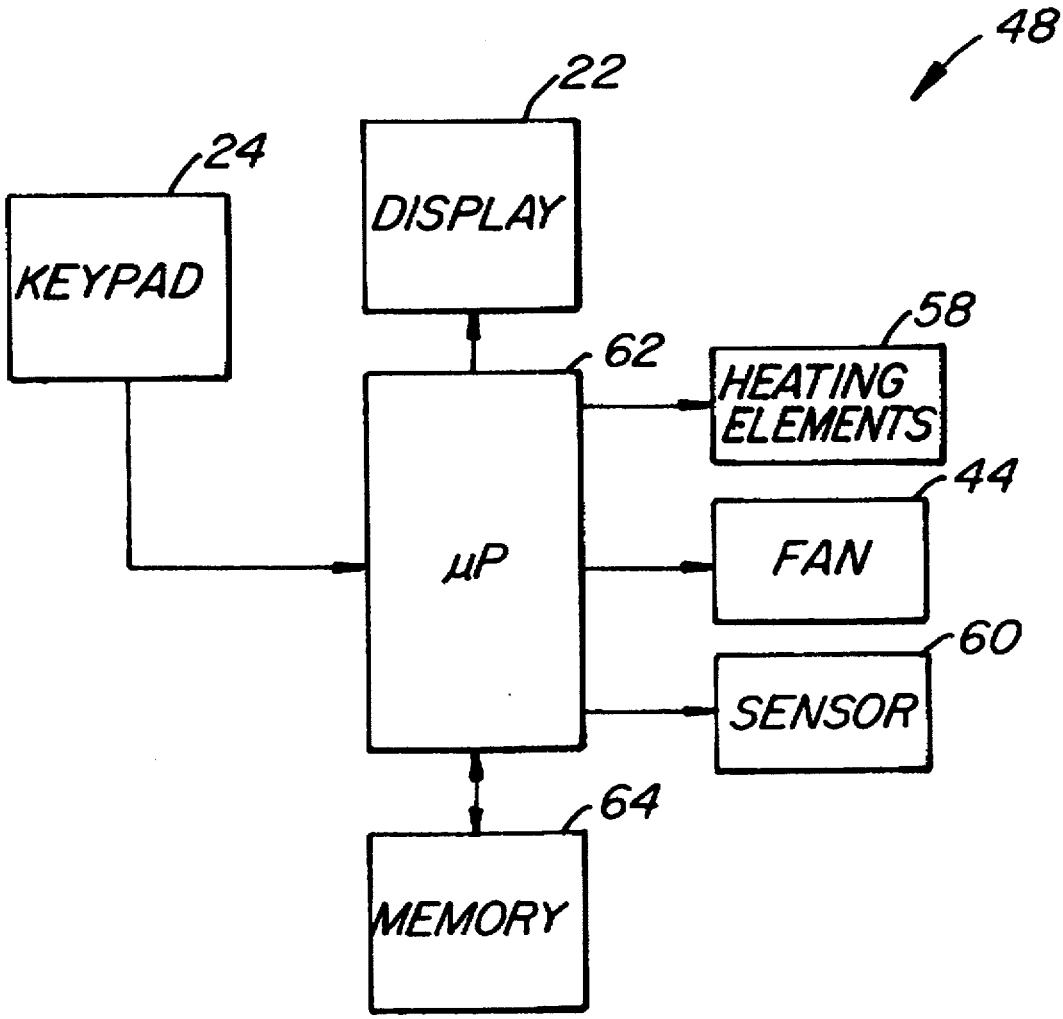
FIG. 4 is a block diagram of the control electronics used in an embodiment of the oven according to the present invention.

Referring again to FIG. 2, a fan blade 40 is mounted inside chamber 18. The fan 40 is positioned centrally on wall 32 of the chamber. The fan 40 spins on a spindle driven by a fan motor 44 which is cooled by a cooling fan 42 coupled to the drive spindle. For a consumer unit, a 4.75" fan blade may be used, while a commercial unit may employ a larger fan blade such as a 6.25" blade. In one specific embodiment, the fan 40 may be driven at up to 3200 RPM. The motor 44 is preferably adjustable and may be controlled via the control electronics 48. The size of the motor 44 is, of course, dictated by the size of the fan 40, the speed required, and the amount of current available for a specific use. A screen 52 may be positioned between the fan and the food basket 38 to prevent user injury from the fan. As shown by briefly referring to FIG. 4, the screen 52 may be a wire mesh screen and is positioned in front of the fan 40 by a mounting bracket 55 attached to wall 32 of the chamber. The bracket 55 may be easily removed if a single release screw 54 is used and if tabs 59*a*, 59*b* are extended through the chamber walls. This allows easy removal of the fan screen 52 for cleaning or repair.

As shown in FIG. 2, the fan blade is positioned in an orientation opposite to typical fan blade orientations. The blades function to force air against wall 32 and swirl in a cyclone effect inside chamber. That is, the fan is mounted so that air is drawn from the vent 56 via the chamber and is distributed radially by the blades. This, in conjunction with the octagonal shape of the chamber 18, causes turbulent air flow with a swirling cyclone effect around the food. Heated air is exhausted from the vent 56 at the far end of the chamber near wall 30. This swirling flow of air causes radiant heat to be stripped from each of the heating elements 58, cooling the rods while transferring heat throughout the chamber. Experimentation has shown that the combination of chamber shape, heating element positioning, and air flow caused by the orientation of the fan produces considerably more convection heat as the fan moves turbulent air down the length of the heating rods. The radiant heat stripped from the rods is converted to evenly-distributed convection heat. The result is an oven which cooks a variety of foods quickly and uniquely. Experimentation has shown that variations in fan size and speed, heating element temperature, and vent size produce a number of distinct cooking characteristics. Experiments have also shown that other fan orientations do not provide similarly desirable results. For example, placement of the fan blade outside of the cooking chamber has been found to be much less effective as the needed swirling/cyclone type air flow is not provided.

It was found that, for the fan orientation shown in FIG. 2, fan speed had a direct impact on the outer surface and texture of food being cooked within the chamber 18. As fan speed is increased, the turbulent air forced down the length of the chamber 18 strips heat from the heating elements 58 and transfers it to the food. As the fan speed is decreased, the amount of radiant heat emitted to the food surface is increased. Different food types require different amounts of convective and radiant heating. Thus, control electronics 48 are provided to allow custom cooking control for different foods. The speed of the fan can be manually controlled or electronically controlled to effect different effects during cooking. For example, if the speed is reduced at the beginning of the cooking process to accentuate the effect of radiative cooking, the food outer surface will tend to seal closed, useful for retaining natural juices in meats. Similarly, if the speed is reduced at the end of the cooking process, the food surface becomes more crispy after the desired internal food texture is achieved, useful for extra crispy french fries or other foods with a deep fry texture.

Referring now to FIG. 6, a block diagram depicting one specific embodiment of control electronics 48 for use in the present invention is shown. The control electronics 48 may include a microprocessor 62 or microcontroller coupled to a memory 64. The memory may be an EEPROM, ROM, or other memory. In the commercial embodiment, information is stored in the memory 64 to allow pre-programming of control information for specific food types. A simpler approach used in a specific embodiment of a consumer unit uses three discrete fan speeds which may be selected from the keypad 24 of the control pad 20. This permits operator selection of cooking modes. Recipes may be produced directing the operator in the proper use of the keys (e.g., two minutes with high fan speed followed by one minute at low fan speed). The processor 62 is coupled to receive input commands from a keypad 24 which is mounted, e.g., on the exterior of the oven 10 as a control pad 20. A display 22 is also provided on the control pad 20 and is coupled to receive display information from the microprocessor 62. The display 22 may be an LCD display or the like. The keypad 24, microprocessor 62, and memory 64 are used together to control the cooking environment within the oven 10. Several basic parameters may be controlled: cooking time; fan speed; heat of each heating element; and the overall temperature of the chamber. Not all of these parameters need be controlled for an oven. For example, in one specific embodiment designed for use by a residential consumer, the individual heating elements 58 are not separately controlled. Instead, adjustments are made by relying solely on the overall time of cooking and fan speed. Experimentation has shown that heat input to the heating elements may be kept constant for a given cooking cycle with cooking completely controlled by adjustments in air flow instead of input energy. In another specific embodiment, all parameters may be controlled by the microprocessor 62, allowing wide control over individual cooking characteristics.

In one specific commercial embodiment, a number of cooking parameters are stored in the memory 64. A user intent on cooking a specific item, e.g., a twelve-inch frozen pizza, may look up the cooking code for the pizza in a users manual, and enter a code (e.g., a four-digit code) into the control electronics 48 via the keypad 24. The microprocessor 62 will retrieve the required record from the memory 64 and perform the steps prescribed to cook a twelve-inch frozen pizza. The steps may include setting an initial heat for each of the heating elements (e.g., 40% of maximum for the top elements and 60% of capacity for the bottom elements), setting an initial fan speed, and setting an internal timer for an initial cooking period. Upon completion of the initial cooking period, the steps stored in memory 64 may then prescribe that the heat from the heating elements be increased for a certain period or that the fan speed be reduced to increase the amount of radiative heat applied to the pizza. Such pre-set computer control of different parameters of the oven 10 allows easy control of the wide capabilities of the oven. Users may also be able to customize oven controls by entering new parameters for different foods into the memory via the keypad 24.

Features and capabilities of ovens 10 according to the present invention are understood by referring to Table 1, where sample control settings for a variety of food items are shown. For the consumer embodiment, the settings will be entered via the keypad manually for each item. The commercial embodiment will include pre-stored instructions which are activated by entering a key several digits long into the keypad. The Table also compares the overall cooking time of each food item to the time required to cook similar items in a conventional oven and, if possible, the time for cooking in a microwave oven. Repeated experimentation has shown that ovens of the present invention produce cooked food having superior taste, texture and quality over previous ovens. The comparative cooking times of the oven of the present invention is reduced further as compared to conventional ovens because the oven 10 does not require a warm up or preheat period. Further, oven 10 does not require a period to thaw, e.g., meats or the like.

TABLE 1

| | COOKING TIME (Minutes) | | | |
|---|---|---|---|---|
| FOOD ITEM | OVEN | CONVEN-TIONAL | CONVECTION | MICROWAVE |
| 12" PIZZA | 3–5 | 15–25 | 6–15 | 3–4 |
| ONION RING | 3–4 | 15–20 | 10–15 | Not Recommended |
| TATER TOTS | 4–5 | 15–25 | 10–17 | Not Recommended |
| STEAK | 6–9 | 20–30 | 15–22 | Not Recommended |
| CHICKEN | 6–9 | 20–30 | 15–22 | 5–7 |
| PASTRY ROLLS | 3–5 | 15–20 | 10–15 | Not Recommended |

Repeated experimentation has shown that ovens according to the present invention are capable of cooking a wide range of foods not satisfactorily cooked by other ovens. Table 2 shows some differences between cooking characteristics.

TABLE 2

| Food Item | Oven 10 | CONVENTIONAL OVEN | CONVECTION OVEN | MICROWAVE OVEN |
|---|---|---|---|---|
| 12" Pizza | Done on top, toasted on bottom | Done on top but not toasted on bottom | Done on top but not toasted on bottom | Done on top, soggy crust and not toasted on bottom |
| Onion Rings | Moist & flavorful inside crisp & deep fried texture outside | Dried out & less flavor inside & no deep fired texture | Dried out & less flavor inside & no deep fried texture | Limp & soggy, no deep fried texture |
| Tater Tots | Moist & flavorful inside, crisp & deep fried texture outside | Dried out & less flavor inside & no deep fried texture | Dried cut & less flavor inside & no deep | Mushy & soggy, no deep fried texture |
| Red Meat Steak | Browned top & bottom, juicy, flavorful & tender | Not browned top & bottom, dried out & tough | Not browned top and bottom, dried out & tough | No browning, poor taste, texture & appearance |
| Chicken Parts | Browned, juicy, flavorful and tender | Less browning, less flavor, meat not as moist | Less browning, less flavor, meat not as moist | No browning, poor taste, texture & appearance |
| Cinnamon Rolls | Browned, plump, moist very flavorful | Less browning, less flavor, not as plump or moist | Less browning, less flavor, not as plump or moist | No browning, dough soggy, very poor appearance & taste |

As will be appreciated by those familiar with the art, the present invention may be embodied in other specific forms without departing from the spirit or essential characteristics thereof. For example, a convectively-enhanced radiant heat oven may be constructed which is smaller or larger than the ovens described in this specification. Further, other shapes of the cooking chamber may be employed which preserve the essential air-flow characteristics of the octagonal shape. Partially circular, pentagonal, hexagonal, or other shapes may also provide desirable results. It is believed that, based upon the foregoing disclosure, those of skill in the art will now be able to produce convectively-enhanced radiant heat ovens having different performance characteristics by modifying the dimensions and scaling of the specific embodiments described. The shape and size of the fan blade may be modified as may the placement and wattage of the heating rods. Further, It is apparent that the present invention may be utilized to cook a wide range of food items quickly and efficiently. Control electronics may be custom designed for specific applications.

Accordingly, the disclosure of the invention is intended to be illustrative, but not limiting, of the scope of the invention which is set forth in the following claims.

What is claimed is:

1. An apparatus for cooking at least a first food item, comprising:

an elongated cooking chamber having a first end and a second end disposed opposite each other;

a holder, removably positioned within said chamber, for holding said at least a first food item;

a plurality of heating devices, spaced apart from said holder, for producing radiative heat within said chamber;

an air circulating device for circulating heated air within said chamber around said at least first food item, said air circulating device positioned within said chamber adjacent said first end; and a vent to provide air exchange between the chamber and an exterior of the device, positioned along a first wall of said chamber near said second end opposite said air circulating device.

2. The apparatus of claim 1 wherein said vent is adjustable for adjusting cooking characteristics of said apparatus.

3. The apparatus of claim 2 wherein said vent is horizontally and vertically adjustable.

4. The apparatus of claim 1 wherein said air circulating device is an adjustable speed fan oriented and structured to force air radially outward to impinge radially upon interior walls of said cooking chamber surrounding said air circulating device near said first end of said chamber.

5. The apparatus of claim 1 wherein said air circulating device is a fan oriented and structured to force air radially outward to impinge radially upon interior walls of said cooking chamber surrounding said air circulating device near said first end of said chamber, wherein said heating devices are elongate rods disposed longitudinally within said chamber between said first and second ends of said chamber, and wherein said chamber is shaped and dimensioned so that said air impinging radially upon said interior walls of said chamber flows through said chamber in a turbulent, cyclone pattern down the length of said rods.

6. The apparatus of claim 1 further comprising an electronic control system coupled to said air circulating device and said plurality of heating devices for controlling cooking characteristics of said apparatus.

7. The apparatus of claim 6 wherein said electronic control system further comprises a microprocessor coupled to said control panel for receiving input and coupled to a display on said control panel for displaying information; and a memory device for storing control information to control cooking of specified food items, wherein said control system allows an operator to select a change of speed of said air circulating device during a given cooking cycle.

8. The apparatus of claim 7, wherein said control system further allows an operator to independently select or change a plurality of cooking parameters before or during a given cooking cycle, said cooking parameters including (1) cooking time; (2) speed of said air circulating device; (3) heat of said heating devices; and (4) overall temperature in the cooking chamber.

9. The apparatus of claim 1 wherein said cooking chamber has an octagonal cross section.

10. A method for cooking at least a first food item in an oven, the method comprising the steps of:

placing said at least first food item on a basket positioned in a cooking chamber of said oven, said cooking chamber having a first end and a second end disposed opposite each other;

applying power to at least a first heating element to generate radiative heat to radiatively heat said first food item, said at least first heating element positioned between said first: and second ends of said cooking chamber;

forcing air through said cooking chamber to convectively heat said at least first food item, said air forced by a fan blade positioned at said first end of said cooking chamber and oriented and structured to direct air radially outward to impinge radially upon interior walls of said cooking chamber surrounding said fan blade near said first end of said cooking chamber.

11. The method of claim 10 including the step of adjustably drawing external air into said cooking chamber from an adjustable air vent positioned along a wall of said cooking chamber near said second end opposite said fan blade, whereby said external air is drawn through said chamber toward said fan blade to be radially circulated by said fan blade.

12. The method of claim 10 including the step of changing a speed of said fan blade during a cooking cycle, whereby radiative cooking by said oven is reciprocally increased or decreased relative to a decrease or decrease in convective cooking by said oven during said cooking cycle.

13. The method of claim 10 wherein said fan blade directs air radially outward to impinge radially upon interior walls of a cross-sectionally octagonal cooking chamber.

14. The method of claim 10, wherein said at least first heating element is an elongate rod disposed longitudinally within said chamber between said first and second ends of said chamber, and wherein said chamber is shaped and dimensioned so that said air impinging radially upon said interior walls of said chamber flows through said chamber in a turbulent, cyclone pattern down a length of said at least first heating element.

15. The method of claim 10 further comprising the steps of:

inputting and receiving, via a control system having a microprocessor based memory, desired cooking characteristic, whereby, based upon said desired cooking characteristics, the speed of said fan and the amount of power supplied to said at least first heating element can be selected and changed before and during a given cooking cycle.

16. The apparatus of claim 1, including four heating elements, two disposed above said holder and two disposed below said holder.

17. The method of claim 15 including the step of independently adjusting an amount of power to at least one of a plurality of heating elements that are each individually adjustable.

18. An apparatus for cooking at least a first food item, comprising:

a cooking chamber including at least a top, a bottom, first and second ends, a front section and a back section coupled together to form a body;

a basket, positioned within said chamber, for holding said at least first food item;

a first pair of heating rods spaced apart from said at least first food item and along said top of said chamber, and a second pair of heating rods spaced apart from said at least first food item and along said bottom of said chamber, said heating rods for producing radiative heat within said chamber;

an air circulating device mounted on said first end for circulating heated air within said chamber, said air circulating device forcing air radially to impinge upon said top and bottom of said cooking chamber near said first end of said chamber to create a turbulent flow along a length of said chamber; and an adjustable vent to provide air exchange between the chamber and an exterior of the apparatus, positioned along said back section of said body nearest said second end opposite said air circulating device, for adjusting cooking characteristics of said apparatus.

19. A device for cooking food in an octagonal chamber having first and second ends positioned opposite each other, the device comprising:

heating means for radiatively heating food held in said chamber, said heating means positioned along a top and a bottom side of said chamber;

air circulating means for circulating heated air through said chamber to convectively heat said food, said circulating means positioned on said first end inside said chamber and forcing air radially outward to impinge radially upon interior walls of said cooking chamber surrounding said air circulating device near said first end of said chamber;

control means for controlling said heating means and said air circulating means for selecting cooking characteristics of said device; and venting means disposed along a bottom edge of said chamber near said second end of said chamber, for regulating air flow within said chamber.

20. The apparatus of claim 18 wherein said air circulating device is a fan oriented and structured to force air radially outward to impinge on interior walls of said cooking chamber surrounding said air circulating device near said first end of said chamber, wherein said heating rods are disposed longitudinally within said chamber between said first and second ends of said chamber, and wherein said chamber is shaped and dimensioned so that said air impinging radially upon said interior walls of said chamber flows through said chamber in a turbulent, cyclone pattern down the length of said rods.

* * * * *